US009567848B2

(12) United States Patent
Adsit

(10) Patent No.: US 9,567,848 B2
(45) Date of Patent: Feb. 14, 2017

(54) SYSTEMS AND METHODS FOR DIAGNOSING A DOWNHOLE TELEMETRY LINK

(71) Applicant: IntelliServ, LLC, Houston, TX (US)

(72) Inventor: Rhys Kevin Adsit, Springville, UT (US)

(73) Assignee: INTELLISERV, LLC, Houston, TX (US)

( * ) Notice: Subject to any disclaimer, the term of this patent is extended or adjusted under 35 U.S.C. 154(b) by 157 days.

(21) Appl. No.: 14/603,585

(22) Filed: Jan. 23, 2015

(65) Prior Publication Data

US 2015/0211360 A1 Jul. 30, 2015

Related U.S. Application Data

(60) Provisional application No. 61/931,777, filed on Jan. 27, 2014.

(51) Int. Cl.

| | |
|---|---|
| ***G01V 3/00*** | (2006.01) |
| ***E21B 47/12*** | (2012.01) |
| ***E21B 17/02*** | (2006.01) |

(52) U.S. Cl.

CPC ..... *E21B 47/12* (2013.01); *E21B 17/028* (2013.01)

(58) Field of Classification Search

CPC combination set(s) only.
See application file for complete search history.

(56) References Cited

U.S. PATENT DOCUMENTS

2005/0046591 A1 3/2005 Pacault et al.
2010/0116550 A1 5/2010 Hutin et al.

OTHER PUBLICATIONS

EP Patent Application No. 15152743.9 Extended European Search Report dated Jul. 7, 2016 (9 pages).

*Primary Examiner* — Brian Zimmerman
*Assistant Examiner* — Thomas McCormack
(74) *Attorney, Agent, or Firm* — Conley Rose, P.C.

(57) ABSTRACT

Systems and methods for downhole telemetry diagnosis. A downhole telemetry system includes a plurality of joints of wired drill pipe connected end-to-end, a first repeater sub, and a second repeater sub. The first repeater sub is connected to an uphole end of the plurality of joints of wired drill pipe. The second repeater sub connected to a downhole end of the plurality of joints of wired drill pipe. The first repeater sub is configured to transmit a signal into one of the joints of wired drill pipe that is connected to the first repeater sub; to detect energy of the transmitted signal returned to the first repeater sub; to measure duration of the returned energy; and to determine an operational state of the first repeater sub based on the measured duration of the returned energy.

21 Claims, 4 Drawing Sheets

SYSTEMS AND METHODS FOR DIAGNOSING A DOWNHOLE TELEMETRY LINK

CROSS REFERENCE TO RELATED APPLICATIONS

This application is a non-provisional application claiming priority to U.S. provisional application Ser. No. 61/931,777, filed on Jan. 27, 2014, entitled "System and Method for Diagnosing a Downhole Telemetry Link," the entire disclosure of which is incorporated by reference herein.

BACKGROUND

While drilling a wellbore in subsurface formations, it is advantageous for measurement and command information to be transferred between the surface and the drilling tools in a timely fashion. Some drilling systems employ a high-speed communication network including communication media (e.g., one or more wires) embedded in the drill pipes to facilitate timely information transfer between surface and downhole systems. Such drill pipe, known as "wired drill pipe" (WDP) includes communicative couplers at each end of each pipe joint and the aforementioned communication media extending between the couplers.

A system employing WDP for communication may include hundreds of individual wired drill pipes connected in series. Repeater subs may be interspersed among the WDPs to extend communication range. If one WDP (or repeater sub) has an electrical fault, then the entire communication system may fail.

SUMMARY

Systems and methods for downhole telemetry diagnosis are disclosed herein. In one embodiment, a downhole telemetry system includes a plurality of joints of wired drill pipe connected end-to-end, a first repeater sub, and a second repeater sub. The first repeater sub is connected to an uphole end of the plurality of joints of wired drill pipe. The second repeater sub connected to a downhole end of the plurality of joints of wired drill pipe. The first repeater sub is configured to transmit a signal into one of the joints of wired drill pipe that is connected to the first repeater sub; to detect energy of the transmitted signal returned to the first repeater sub; to measure duration of the returned energy; and to determine an operational state of the first repeater sub based on the measured duration of the returned energy.

The second repeater sub may include a backscatter device that is configured to be activated by the signal and reflect an encoded signal to the first repeater sub. The first repeater sub may be configured to detect the encoded return signal in the returned energy; and to determine, based on detection of the encoded return signal that the signal transmitted by the first repeater sub reached the second repeater sub.

The first repeater sub may be configured to compare an amplitude of the returned energy to a start threshold value and an end threshold value, and to set the duration of the returned energy to be time between when the return energy exceeds the first threshold and when the return energy falls below the second threshold.

The system may also include telemetry system analysis logic configured to identify a fault in the first repeater sub based on the duration being less than a predefined minimum value, and/or to identify a fault in a fault in the first repeater sub based on the duration being greater than a predefined maximum value, and/or to identify the first repeater sub and the joints of wired drill pipe as operating properly based on the duration being within a predefined range between the predefined minimum value and the predefined maximum value.

The second repeater sub may be configured to transmit a signal into one of the joints of wired drill pipe that is connected to the second repeater sub, to detect energy of the transmitted signal returned to the second repeater sub, to measure duration of the returned energy, and to determine an operational state of the second repeater sub based on the measured duration of the returned energy.

The first repeater sub may also be configured to apply magnitude-edge detection to the returned energy, and determine an operational state of the first repeater sub based on a result of the magnitude-edge detection. The first repeater sub may also be configured to apply phase shift detection to the returned energy, and determine an operational state of the first repeater sub based on a result of the phase shift detection. The first repeater sub may also be configured to vary duration, magnitude, or frequency of the signal transmitted based on distance to be traversed by the signal. The first repeater sub may determine operational state based on measure duration of the returned energy, result of magnitude-edge detection, and/or result of phase shift detection.

The system may also include a surface system that includes a third repeater sub communicatively coupled to a drill string. The third repeater sub is configured to transmit a signal into the drill string, to detect energy of the transmitted signal returned to the third repeater sub, to measure duration of the returned energy; and to determine an operational state of the third repeater sub based on the measured duration of the returned energy.

In another embodiment, a method for diagnosing a downhole telemetry system includes transmitting, by a repeater sub disposed in drill string, a signal into a wired drill pipe connected to the repeater sub; detecting, by the repeater sub, energy of the signal that is returned to the repeater sub via the wired drill pipe; measuring the duration of the energy returned; and determining an operational state of the repeater sub based on the measured duration of the energy returned.

The method may include detecting, in the energy returned, an encoded return signal generated by a backscatter device of a downhole tool communicative coupled to the repeater sub via the wired drill pipe; and determining, based on detection of the encoded return signal that the signal transmitted by the repeater sub reached the downhole tool.

The method may include comparing an amplitude of the returned energy to a start threshold value and an end threshold value, and setting the duration of the returned energy to be time between when the return energy exceeds the first threshold and when the return energy falls below the second threshold.

The method may include identifying a fault in the repeater sub based on the duration being less than a predefined minimum value, and/or identifying a fault in the repeater sub based on the duration being greater than a predefined maximum value, and/or identifying the repeater sub and the wired drill pipe as operating properly based on the duration being within a predefined range between the predefined minimum value and the predefined maximum value.

The method may include initiating detection of energy of the transmitted signal returned to the repeater sub based on signal transmission by the repeater sub being complete.

In a further embodiment, a downhole telemetry system includes a repeater sub configured to retransmit data received via telemetry. The repeater sub includes a first modem and a second modem. The first modem includes a first transmitter and a first receiver. The second modem includes a second transmitter and a second receiver. The repeater sub is configured to transmit a first signal into a first telemetry channel that is coupled to the first modem; to detect energy of the transmitted first signal returned to the first receiver; to measure duration of the returned energy; and to determine an operational condition of the repeater sub based on the measured duration of the returned energy.

The first telemetry channel may include a backscatter device that is configured to be activated by the first signal and reflect an encoded signal to the repeater sub. The repeater sub may be configured to detect the encoded return signal in the returned energy; and to determine, based on detection of the encoded return signal that the first signal transmitted by the repeater sub successfully traversed the first telemetry channel.

The repeater sub may be configured to compare an amplitude of the returned energy to a start threshold value and an end threshold value, and to set the duration of the returned energy to be time between when the return energy exceeds the first threshold and when the return energy falls below the second threshold.

The repeater sub may be configured to identify a fault in the repeater sub based on the duration being less than a predefined minimum value; and/or to identify a fault in a fault in the repeater sub based on the duration being greater than a predefined maximum value; and/or to identify the repeater sub and the first telemetry channel as operating properly based on the duration being within a predefined range between the predefined minimum value and the predefined maximum value.

BRIEF DESCRIPTION OF THE DRAWINGS

For a detailed description of exemplary embodiments of the invention, reference is now be made to the figures of the accompanying drawings. The figures are not necessarily to scale, and certain features and certain views of the figures may be shown exaggerated in scale or in schematic form in the interest of clarity and conciseness.

NOTATION AND NOMENCLATURE

Figure 1:
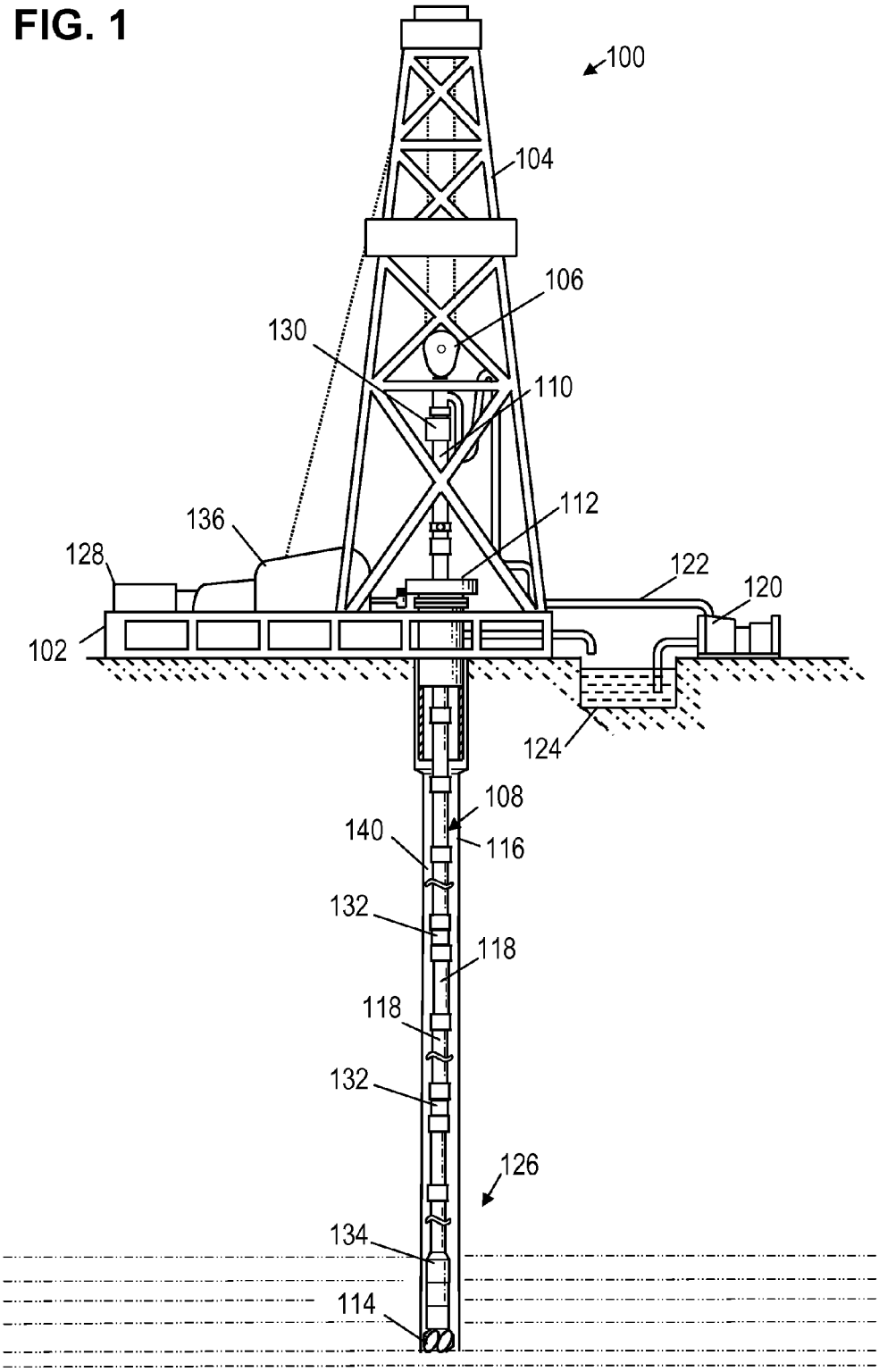
FIG. 1 shows a drilling system that includes wired drill pipe and wired drill pipe fault location in accordance with principles disclosed herein.

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to. . . ." Also, the term "couple" or "couples" is intended to mean either an indirect or direct connection. Thus, if a first device couples to a second device, that connection may be through direct engagement of the devices or through an indirect connection via other devices and connections. The recitation "based on" means "based at least in part on." Therefore, if X is based on Y, X may be based on Y and any number of other factors. Any reference to up or down in the description and the claims is made for purposes of clarity, with "up", "upper", "upwardly", "uphole", or "upstream" meaning toward the surface of the borehole and the network origination at the surface; and with "down", "lower", "downwardly", "downhole", or "downstream" meaning toward the terminal end of the borehole and the network termination, regardless of the borehole orientation.

DETAILED DESCRIPTION

The following discussion is directed to various illustrative embodiments of the invention. The embodiments disclosed are not to be interpreted, or otherwise used, to limit the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Drill strings employed for oil, gas and other drilling applications may extend for thousands of feet. In drill strings that employ wired drill pipe (WDP) telemetry systems, transmitted signals are greatly attenuated while traversing the drill pipes. To maintain signal integrity, signal repeaters (also referred to herein as "Links") are used to amplify and/or re-create the signals passing through the telemetry system in each direction. The WDP telemetry system can be divided into "sections", where each section includes wired drill pipes, an uphole link at the uphole end of the wire drill pipes of the section, and a downhole link at the downhole end of the wired drill pipes of the section. The links include electronics, wiring, power generation, and/or storage devices that are subject to a significant probability of failure in one or more subsystems.

Communication traffic in each section is governed and observed by the links at either end of the section. Instruments outside of the section rely on the reports from the two links associated with the section to ascertain link integrity. When communication within a section is lost, the fault may be in any of the uphole link, the wired drill pipes, or the downhole link.

Conventional systems using WDP typically pre-suppose that the pipe diagnostics tool is operating properly. If links are used to conduct pipe diagnostics downhole but the section-bounding link conducting the diagnostics is faulty, then the pipe diagnostics result may be misleading. Given the variety of possible link faults, which of the two links and the wired drill pipes of a section are the root cause of a fault may be impossible to determine using conventional methods.

Embodiments of the WDP telemetry system disclosed herein include link diagnostic systems in each link that can determine whether the link is properly driving signal into and/or receiving signal from the wired drill pipes. Accordingly, embodiments disclosed herein can reduce the time and cost associated with isolating WDP failures by determining whether a fault in a given section lies in a link or the wired drill pipes.

FIG. 1 shows a drilling system 100 that includes wired drill pipe (WDP) 118 and link fault diagnostics in accordance with principles disclosed herein. In the drilling system 100, a drilling platform 102 supports a derrick 104 having a traveling block 106 for raising and lowering a drill string 108. A kelly 110 supports the drill string 108 as it is lowered through a rotary table 112. In some embodiments, a top drive is used to rotate the drill string 108 in place of the kelly 110 and the rotary table 112. A drill bit 114 is positioned at the downhole end of the tool string 126, and is driven by rotation of the drill string 108 or by a downhole motor (not shown) positioned in the tool string 126 uphole of the drill bit 114. As the bit 114 rotates, it removes material from the various formations 136 and creates the borehole 116. A pump 120 circulates drilling fluid through a feed pipe 122 and downhole through the interior of drill string 108, through orifices in drill bit 114, back to the surface via the annulus 140 around drill string 108, and into a retention pit 124. The drilling fluid transports cuttings from the borehole 116 into the pit 124 and aids in maintaining the integrity of the borehole 116.

The drill string 108 includes a plurality of lengths (or joints) of wired drill pipe 118 that are communicatively coupled end-to-end. A surface sub 130 communicatively couples the wired drill pipes 118 to surface processing systems, such as the drilling control/analysis computer 128. The drill string 108 may also include a bottom hole assembly (BHA) interface 134 and links 132. The BHA interface 134 communicatively couples the WDP 118 to the tools of the bottom hole assembly. The links 132 are interspersed among with the wired drill pipes 118, and may boost and/or re-create the WDP signal transmitted through the drill string 108. The spacing between the links 132 may be related to the efficiency (e.g., attenuation) of the wired drill pipes 118. The lower the attenuation, the greater the distance (e.g., the number of WDP joints) between links 132. Links 132 may be individually addressable, so that a command can be sent from the surface computer 128 to a selected link 132. In response to the command, the selected link 132 may transmit an acknowledgement to the surface computer 128. Such individual addressability and command/response protocol can be used to verify that the WDPs 118 (i.e., the WDP system) are working correctly between the surface and the selected links 132.

Each of the links 132 includes circuitry and/or logic that allows the link 132, or other system communicating with the link 132, to determine whether or not a modem of the link 132 is able to transmit and receive via the associated WDPs 118. The links described herein include the drill string links 132, and/or a surface sub that may include a link, and/or the surface computer 128 that may a link.

Figure 2:
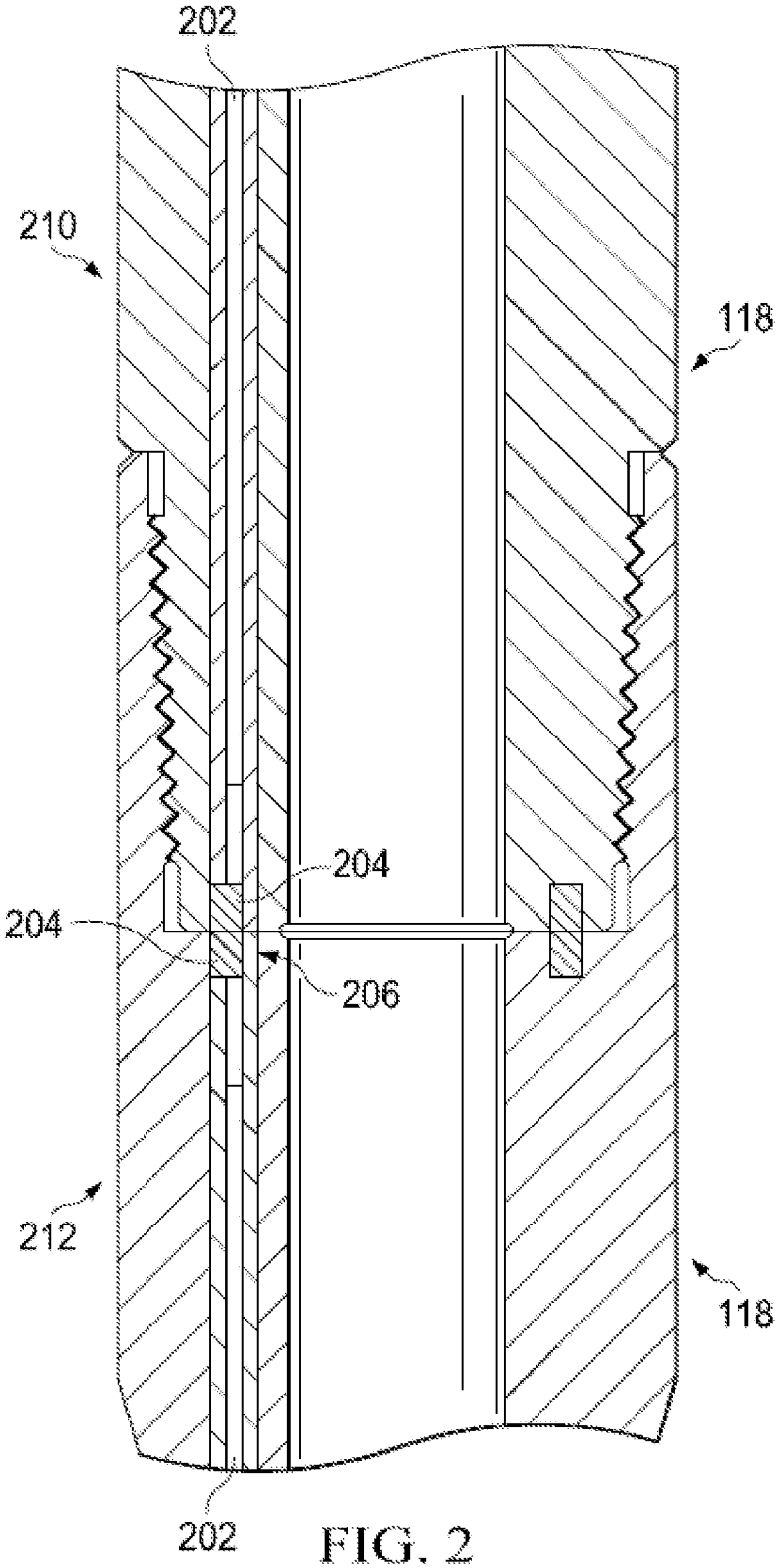
FIG. 2 shows a longitudinal cross-section of inductively coupled wired drill pipes in accordance with principles disclosed herein.

FIG. 2 shows a longitudinal cross-section of a mated pair of wired drill pipes 118 in accordance with principles disclosed herein. Each WDP 118 includes a communicative medium 202 (e.g., a coaxial cable, twisted pair, etc.) structurally incorporated or embedded over the length of the pipe 118, and an interface 206 at each end of the pipe 118 for communicating with an adjacent WDP 118, sub, link 132, or other component. The communicative medium 202 is connected to each interface 206. In some embodiments, the interface 206 may include an inductive coupler 204 (e.g., an annular inductive coupler) for forming a communicative connection with the adjacent component. The inductive coupler 204 may be embedded in insulating material, and may include a coil and magnetically permeable material, a toroid and conductive shell, etc. For example, FIG. 2 shows a pin end 210 of a first wired drill pipe 118 mated to a box end 212 of a second wired drill pipe 118 such that inductive couplers 204 of the wired drill pipes 118 connect the cables 202 of the two wired drill pipes 118. The high bandwidth of the wired drill pipes 118 allows for transfers of large quantities of data at a high transfer rate.

Figure 3:
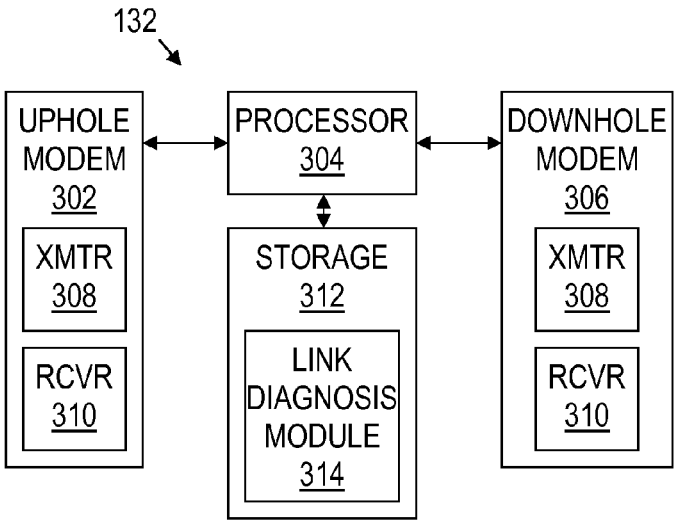
FIG. 3 shows a block diagram of a wired drill pipe fault link device in accordance with principles disclosed herein.

FIG. 3 shows block diagram of a link 132 in accordance with principles disclosed herein. The link 132 includes an uphole modem 302, a link processor 304, and a downhole modem 306. The uphole modem 302 transmits signals into and receives signals from wired drill pipes 118 uphole of the link 132. The downhole modem 306 transmits signals into and receives signals from wired drill pipes 118 downhole of the link 132. The processor 304 controls and provides data to the uphole modem 302 and the downhole modem 306.

Each of the modems 302, 306 includes a transmitter 308 and a receiver 310. The transmitter 308 drives signals to the attached wired drill pipe 118. The receiver 310 receives signals from the attached wired drill pipe 118.

If the uphole modem 302 and/or the processor 304 fails, then the link 132 will be unable to communicate uphole, and will not be seen at the surface. Similarly, if the downhole modem 306 fails, the link 132 will be unable to communicate downhole. In conventional systems, if only the downhole modem 306 fails, then links 132 downhole of the defective link 132 will not be seen at the surface, and whether the fault is in the defective link 132, links 132 downhole of the defective link 132, or WDP between the links 132 cannot be determined. Accordingly, in a conventional system, both the defective link 132 and the link 132 downhole of the defective link may be replaced, which increases system operating expense.

The processor 304 may be general purpose microprocessor, microcontroller, digital signal processor, or other device that executes instructions to provide the functionality disclosed herein. The storage 312 is a computer-readable storage device (e.g., a volatile or non-volatile memory device) that stores and provides to the processor 304 instructions for execution. The storage 312 includes a link diagnosis module 314. The link diagnosis module 314 includes instructions that are executable by the processor 304 to provide the link validation functions disclosed herein. For example, the processor 304 may execute instructions of the link diagnosis module 314 to cause the link 132 to transmit a test signal into the wired drill pipe 118, to time the duration of energy return from the wired drill pipes to the link 132, and to determine the condition of the link 132 based on the duration of energy return as disclosed herein.

Figure 4:
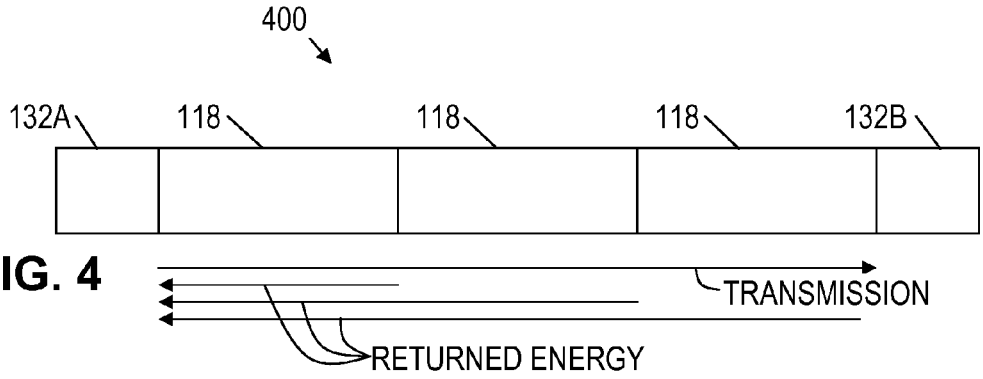
FIG. 4 shows a block diagram of a section of a wired drill pipe telemetry system in accordance with principles disclosed herein.

FIG. 4 shows a block diagram of a WDP section 400 including links 132A and 132B and a number of joints of wired drill pipe 118. The WDP section 400 may be a portion of the drill string 108. The links 132A, 132B are instances of the link 132. Accordingly, any feature described with regard to link 132A or link 132B may be included in any link 132. In practice, the WDP section 400 may include many more joints of wired drill pipe 118 than are shown in FIG. 4. The joints of wired drill pipe 118 include inductive and capacitive components. Therefore, when electrically stimulated, each joint of wired drill pipe 118 reacts like a resonant electrical circuit. A portion of the energy driven into a joint of pipe 118 by the link 132A is reflected back to the link 132A, while most of the energy is passed through to the next joint of pipe 118. Thus, when a link 132A drives a signal into the wired drill pipe 118, the pipe 118 will return energy to the link 132A, and the output of the link 132A will gradually settle after the transmission ends. The amount of energy returned to the link 132A is a function of the channel into which the link 132A transmits. For example, different numbers of interconnected joints of wired drill pipe 118 will have different resonant signatures. Similarly, with a faulty link modem (e.g., the downhole modem 306) or faulty output wiring of the link 132A, a non faulty channel will respond with a unique and identifiable signature.

The communication channel formed by the wired drill pipes 118 may include other features that reflect back energy provided by a link 132A. For example, impedance change boundaries (e.g., at the inductive couplers) in the wired drill pipes 118 will reflect energy back to the link 132. Similarly, the front end of the receiver at the link 132B to which signal is transmitted by link 132A may reflect signal back to the transmitting link 132A. The transmitting link 132A receives the reflected energy, with the closer and stronger reflections received first, and those from more distant pipes 118 received later. Some embodiments of the section 400 may also include a back-scatter device, such as a radio frequency identification (RFID) tag, that when activated by signal transmitted by the link 132A, reflects encoded energy back to the link 132A. The link 132A may include circuitry to identify signals generated by an RFID tag or other predetermined resonant pipe features.

In one embodiment, the link 132A transmits a test signal into the wired drill pipes 118. The test signal may be a signal optimized for testing the link 132A or an ordinary data transmission. To reduce the output blanking or increase the range, the link 132A may vary the duration or magnitude of the transmitted test signal, and/or vary the gain applied to reflected signal. As noted above, the pipes 118 reflect a portion of the transmitted energy back towards the transmitting link 132A.

The link 132A monitors the receiver of the transmitting modem (e.g., the downhole mode 306), and analyzes the response of a carrier detect circuit of the transmitting modem and signals reflected back into the transmitting modem at the end of the test signal. As transmission of the test signal completes, the link 132A measures the response duration of the echoed signal. For example, the link 132A may measure the time from the end of the transmitted test signal to the point at which the receiver is no longer able to detect the response. The duration of signal detection is indicative of link 132A and/or segment status. Short durations may indicate a fault in the link 132A, because there was no channel response. Durations greater than a predetermined threshold may indicate that the link 132A has successfully transmitted into the channel, and that the link receiver was able to detect the response.

Thus, the duration of the response, rather than a magnitude, edge or phase discontinuity, may suggest a failure condition or other status of the link 132A. In some embodiments, a short response (e.g., about 2.5 micro-seconds or less) may indicate that the link 132A is faulty or a fault is located near the link 132A (e.g., within a joint or 2 of pipe 118). A long response (e.g., about 12 micro-seconds or more) may indicates that an output line of the link 132A has a hard fault such as an open or short. A normal response (e.g. about 5 micro-seconds) indicates that the output of the link 132 A is properly connected to a healthy pipe section, If the link 132A is able to receive the expected return energy from the channel, then the link 132A can conclude that it is actually sending and receiving into the channel. The described diagnostic method is advantageous because the transmitter and receiver used to perform the testing are already included in the link 132A, no special test signal is needed, measurement of reflected signal duration does not require magnitude thresholding or phase measurements, and the method does not depend on information transmitted by the link 132B at the other end of the section 400.

Some embodiments of the link 132 may include a loop-back or takeout circuit at the output of one or more of the modems 302, 306 to provide signal blanking, timing, or comparison. A circulator or coupler may be included in the modems 302, 306 to allow simultaneous transmission and reception to reduce or eliminate the output blanking. Embodiments may also include magnitude edge detection, false-edge rejection, noise or interference rejection, and/or phase shift detection. The test signal driven into the wired drill pipes 118 by the link 132 may be of short-duration to reduce output masking. Each of the links 132 may provide test signals and testing from both the uphole modem 302 and the downhole modem 306. Accordingly, each pipe section may be tested from both directions with test results stored in a memory of the link 132 for later reporting.

Figure 5:
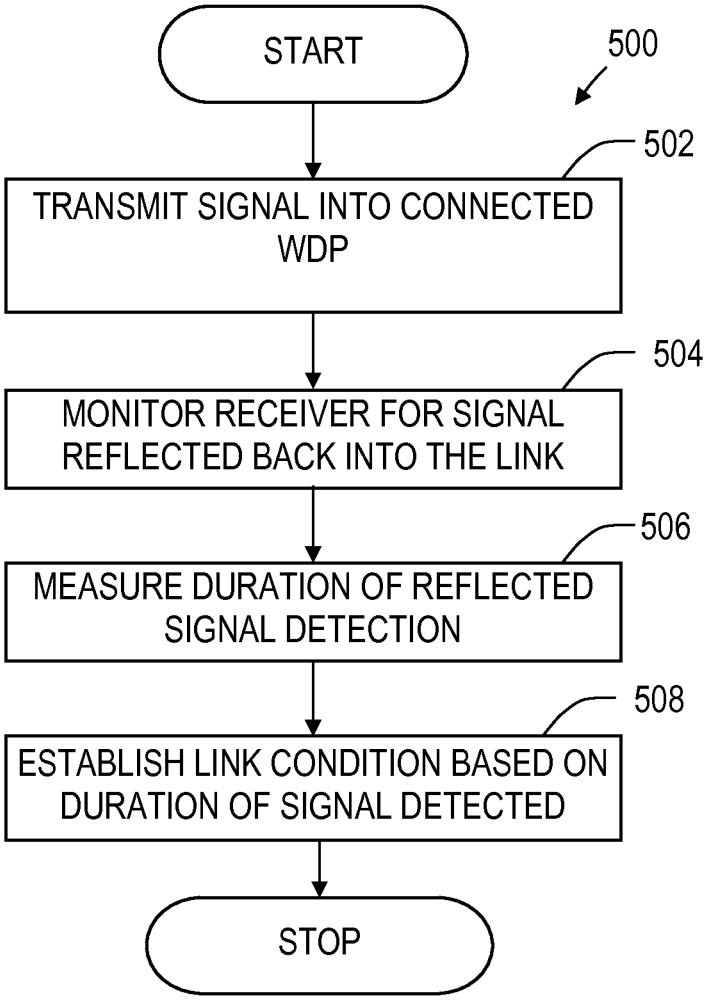
FIG. 5 shows a flow diagram for a method for diagnosing operation of a link in a wired drill pipe telemetry system in accordance with principles disclosed herein.

FIG. 5 shows a flow diagram for a method 500 for determining the condition of a link 132 in a drill string 108 in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 500 may be performed by the processor 304 executing instructions read from a computer-readable medium.

In block 502, the drill string 108 is disposed in the borehole 116, and a link 132A disposed in the drill string 108 initiates validation of the link 132A by transmitting a signal into the wired drill pipe 118 connected to the link 132A. The transmission may be uphole or downhole to test the uphole modem 302 or the downhole modem 306 respectively.

In block 504, the link 132A monitors the receiver 310 of the transmitting modem for the presence of signal reflected by the wired drill pipes 118, the link 132B, or other features of the communication channel formed in the drill string section 400.

In block 506, the link 132A measures the duration over which reflected signal of the test transmission is detected.

In block 508, the link 132A determines its condition based on the duration of detection of the reflected signal. For example, a detected signal duration less than a short response threshold value may indicate that the link 132A is faulty or a fault is located in the wired drill pipes 118 near the link 132A. A detected signal duration greater than a long response threshold value may indicate that the link 132A has a hard fault such as an open or short. A detected signal duration within a normal response range may indicate that the output of the link 132A is operating properly and is connected to healthy wired drill pipes 118.

Other embodiments apply the principles disclosed herein to validate the operation of repeaters in downhole telemetry systems that employ a communication channel that includes media other than wired drill pipes. For example, one embodiment employs cables through or along downhole tubulars (e.g., drill pipes, well casing, riser tubes, etc.) with repeater units disposed to connect the ends of each pair of cables. More generally, embodiments are applicable to repeater validation and diagnosis in downhole, subsea, or other telemetry systems that employ repeaters coupled by a communication channel that returns to the repeater a portion of the energy injected into the channel when the repeater transmits via the channel. In various embodiments, the repeaters and associated communication channel may provide communication via electromagnetic energy, acoustical energy (pressure waves), etc.

The above discussion is meant to be illustrative of various principles and embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A downhole telemetry system, comprising:

a plurality of joints of wired drill pipe connected end-to-end;

a first repeater sub connected to an uphole end of the plurality of joints of wired drill pipe;

a second repeater sub connected to a downhole end of the plurality of joints of wired drill pipe;

wherein the first repeater sub is configured to:

transmit a signal into one of the joints of wired drill pipe that is connected to the first repeater sub;

detect energy of the transmitted signal returned to the first repeater sub;

measure duration of the returned energy; and determine an operational state of the first repeater sub based on the measured duration of the returned energy.

2. The system of claim 1, wherein the second repeater sub includes a backscatter device that is configured to be activated by the signal and reflect an encoded signal to the first repeater sub; wherein the first repeater sub is configured to:

detect the encoded return signal in the returned energy; and determine, based on detection of the encoded return signal that the signal transmitted by the first repeater sub reached the second repeater sub.

3. The system of claim 1, wherein the first repeater sub is configured to:

compare an amplitude of the returned energy to a start threshold value and an end threshold value, and set the duration of the returned energy to be time between when the return energy exceeds the first threshold and when the return energy falls below the second threshold.

4. The system of claim 1, further comprising telemetry system analysis logic configured to identify a fault in the first repeater sub based on the duration being less than a predefined minimum value.

5. The system of claim 1, wherein the telemetry system analysis logic is configured to identify a fault in a fault in the first repeater sub based on the duration being greater than a predefined maximum value.

6. The system of claim 1, wherein the telemetry analysis logic is configured to identify the first repeater sub and the joints of wired drill pipe as operating properly based on the duration being within a predefined range between the predefined minimum value and the predefined maximum value.

7. The system of claim 1, further comprising a surface system comprising:

a third repeater sub communicatively coupled to a drill string, the third repeater sub configured to:

transmit a signal into the drill string;

detect energy of the transmitted signal returned to the third repeater sub;

measure duration of the returned energy; and determine an operational state of the third repeater sub based on the measured duration of the returned energy.

8. The system of claim 1, wherein the second repeater sub is configured to:

transmit a signal into one of the joints of wired drill pipe that is connected to the second repeater sub;

detect energy of the transmitted signal returned to the second repeater sub;

measure duration of the returned energy; and determine an operational state of the second repeater sub based on the measured duration of the returned energy.

9. The system of claim 1, wherein the first repeater sub is configured to:

apply magnitude-edge detection to the returned energy, and determine an operational state of the first repeater sub based on a result of the magnitude-edge detection; or apply phase shift detection to the returned energy, and determine an operational state of the first repeater sub based on a result of the phase shift detection; or vary duration, magnitude, or frequency of the signal based on distance to be traversed by the signal.

10. A method for diagnosing a downhole telemetry system, comprising:

transmitting, by a repeater sub disposed in drill string, a signal into a wired drill pipe connected to the repeater sub;

detecting, by the repeater sub, energy of the signal that is returned to the repeater sub via the wired drill pipe;

measuring the duration of the energy returned; and determining an operational state of the repeater sub based on the measured duration of the energy returned.

11. The method of claim 10, further comprising:

detecting, in the energy returned, an encoded return signal generated by a back-scatter device of a downhole tool communicative coupled to the repeater sub via the wired drill pipe; and determining, based on detection of the encoded return signal that the signal transmitted by the repeater sub reached the downhole tool.

12. The method of claim 10, further comprising:

comparing an amplitude of the returned energy to a start threshold value and an end threshold value, and setting the duration of the returned energy to be time between when the return energy exceeds the first threshold and when the return energy falls below the second threshold.

13. The method of claim 10, further comprising identifying a fault in the repeater sub based on the duration being less than a predefined minimum value or greater than a predefined maximum value.

14. The method of claim 13, further comprising identifying the repeater sub and the wired drill pipe as operating properly based on the duration being within a predefined range between the predefined minimum value and the predefined maximum value.

15. The method of claim 10, further comprising initiating detection of energy of the transmitted signal returned to the repeater sub based on signal transmission by the repeater sub being complete.

16. A downhole telemetry system, comprising:

a repeater sub configured to retransmit data received via telemetry, the repeater sub comprising:

a first modem comprising:

a first transmitter; and a first receiver; and a second modem comprising:

a second transmitter; and a second receiver;

wherein the repeater sub is configured to:

transmit a first signal into a first telemetry channel that is coupled to the first modem;

detect energy of the transmitted first signal returned to the first receiver;

measure duration of the returned energy; and determine an operational state of the repeater sub based on the measured duration of the returned energy.

17. The system of claim 16, wherein the repeater sub is configured to:

transmit a second signal into a first telemetry channel that is coupled to the second modem;

detect energy of the transmitted second signal returned to the second receiver;

measure duration of the returned energy; and determine an operational state of the repeater sub based on the measured duration of the returned energy.

18. The system of claim 16, wherein the first telemetry channel includes a backscatter device that is configured to be activated by the first signal and reflect an encoded signal to the repeater sub; wherein the repeater sub is configured to:

detect the encoded return signal in the returned energy; and determine, based on detection of the encoded return signal that the first signal transmitted by the repeater sub successfully traversed the first telemetry channel.

19. The system of claim 16, wherein the repeater sub is configured to:

compare an amplitude of the returned energy to a start threshold value and an end threshold value, and set the duration of the returned energy to be time between when the return energy exceeds the first threshold and when the return energy falls below the second threshold.

20. The system of claim 15, wherein the repeater sub is configured to:

identify a fault in the repeater sub based on the duration being less than a predefined minimum value; and identify a fault in a fault in the repeater sub based on the duration being greater than a predefined maximum value.

21. The system of claim 16, wherein the repeater sub is configured to identify the repeater sub and the first telemetry channel as operating properly based on the duration being within a predefined range between the predefined minimum value and the predefined maximum value.

* * * * *